US007563008B2

(12) United States Patent
Chinniah et al.

(10) Patent No.: US 7,563,008 B2
(45) Date of Patent: Jul. 21, 2009

(54) LED PROJECTOR HEADLAMPS USING SINGLE OR MULTI-FACETED LENSES

(75) Inventors: Jeyachandrabose Chinniah, Canton, MI (US); Amir P. Fallahi, W. Bloomfield, MI (US); Edwin M. Sayers, Saline, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 294 days.

(21) Appl. No.: 11/391,067

(22) Filed: Mar. 28, 2006

(65) Prior Publication Data

US 2007/0236952 A1 Oct. 11, 2007

(51) Int. Cl.
*F21V 5/00* (2006.01)

(52) U.S. Cl. ..... 362/520; 362/522; 362/538; 362/336

(58) Field of Classification Search ..... 362/509, 362/520, 522, 538, 308, 336, 338
See application file for complete search history.

(56) References Cited

U.S. PATENT DOCUMENTS

| | | | | |
|---|---|---|---|---|
| 2,813,971 | A * | 11/1957 | Pickett | 362/327 |
| 3,876,285 | A | 4/1975 | Schwarzmüller | |
| 4,517,630 | A | 5/1985 | Dieffenbach et al. | |
| 4,914,747 | A | 4/1990 | Nino et al. | |
| 6,109,772 | A * | 8/2000 | Futami et al. | 362/517 |
| 6,367,950 | B1 | 4/2002 | Yamada et al. | |
| 6,461,024 | B1 | 10/2002 | Becker et al. | |
| 6,575,610 | B2 | 6/2003 | Natsume | |
| 6,599,002 | B2 | 7/2003 | Hsich et al. | |
| 6,619,825 | B2 | 9/2003 | Natsume | |
| 6,659,629 | B2 | 12/2003 | Potter et al. | |
| 6,739,743 | B2 | 5/2004 | Koshiro et al. | |
| 6,764,208 | B2 | 7/2004 | Nakata | |
| 6,866,408 | B1 * | 3/2005 | Albou | 362/518 |
| 6,882,110 | B2 | 4/2005 | Ishida et al. | |

(Continued)

FOREIGN PATENT DOCUMENTS

EP 1357332 A 10/2003

(Continued)

OTHER PUBLICATIONS

Paul Sharke, "let light be there," © 2000 The American Society of Mechanical Engineers, 8 pgs.

(Continued)

*Primary Examiner*—Thomas M Sember
(74) *Attorney, Agent, or Firm*—Brinks Hofer Gilson & Lione

(57) ABSTRACT

A condenser lens and a headlamp assembly employing the condenser lens improves control over the beam spread characteristics, while at the same time reduces the package size of the headlamp assembly. The condenser lens is provided for a projector-type headlamp assembly having a light source emitting light which is projected longitudinally downstream in front of a motor vehicle. The condenser lens generally includes a main body of light transmitting material. The main body defines a first surface receiving light from the light source and a second surface emitting the light. The second surface has at least one facet structured to spread the light and provide a predetermined beam pattern.

23 Claims, 7 Drawing Sheets

U.S. PATENT DOCUMENTS

| | | | | |
|---|---|---|---|---|
| 7,284,888 | B2 * | 10/2007 | Pauty et al. | 362/539 |
| 2002/0191395 | A1 | 12/2002 | Fleury | |
| 2002/0196639 | A1 | 12/2002 | Weidel | |
| 2004/0160785 | A1 | 8/2004 | Kato et al. | |
| 2004/0208018 | A1 | 10/2004 | Sayers et al. | |
| 2005/0018443 | A1 | 1/2005 | Tsukamoto | |
| 2005/0086032 | A1 | 4/2005 | Benitez et al. | |
| 2005/0180158 | A1 | 8/2005 | Komatsu | |
| 2005/0219856 | A1 | 10/2005 | Tatsukawa | |
| 2005/0219858 | A1 | 10/2005 | Yamamura et al. | |
| 2005/0254254 | A1 | 11/2005 | Moseler et al. | |
| 2005/0270791 | A1 | 12/2005 | Lee | |
| 2006/0007692 | A1 * | 1/2006 | Hsien | 362/382 |
| 2006/0239021 | A1 | 10/2006 | Inaba | |

FOREIGN PATENT DOCUMENTS

| | | | |
|---|---|---|---|
| EP | 1647764 | A2 | 4/2006 |
| JP | 1319201 | | 12/1989 |
| JP | 2005-243590 | | 9/2005 |

OTHER PUBLICATIONS

UK Search Report (Jul. 9, 2007).

* cited by examiner

LED PROJECTOR HEADLAMPS USING SINGLE OR MULTI-FACETED LENSES

FIELD OF THE INVENTION

The present invention relates generally to motor vehicle headlamps, and more particularly relates to headlamps of the projector-type which employ a condenser lens.

BACKGROUND OF THE INVENTION

Light emitting diodes (LED's) are fast becoming the preferable light source for automotive lighting applications, as they consume less power but provide light output which is becoming acceptable for such applications. When LED's are employed in headlamps (i.e., headlights), several requirements must be met. Specifically, the beam pattern provided in road illumination should have a certain amount of vertical spread as well as a certain amount of horizontal spread. At the same time, a vertical cut-off should be provided to minimize glare to oncoming traffic.

Generally, headlamps for motor vehicles can be characterized as reflector-type headlamps or projector-type headlamps. Reflector-type headlamps employ a specially structured reflector unit which collects and redirects light from the light source, and are especially constructed to focus the light as well as provide the necessary beam spread. In projector-type headlamps, a standard projector unit employs a reflector that collects light from the LED light source and provides the beam spread. Light from the reflector passes through a condenser lens which simply and projects light from the reflector for illuminating the roadway. In a direct projector unit, no reflector is employed and a limited amount of control, is available over the beam spread through selection of the light source and its position relative to the condenser lens.

The condenser lens is an imaging optic which simply projects the image placed at its focal point onto the road, thereby creating a beam pattern simply by inverting the source (left is right and up is down). These condenser lenses are aspheric lenses which are axi-symmetric and obtained by a surface revolution of a two-dimensional curve about the optic axis (i.e., a longitudinal axis extending through the lens center). To obtain control over the beam spread characteristics, the reflector of the standard projector-type headlamp is elongated, primarily in the horizontal direction, in order to obtain the desired beam spread characteristics. Desirably, the vertical beam spread is about −10° while the horizontal beam spread is about +/−35°.

In view of the foregoing, there exists a need to provide a projector-type headlamp which exhibits improved control over the beam spread characteristics of the outputted light.

BRIEF SUMMARY OF THE INVENTION

The present invention provides a condenser lens and a headlamp assembly employing the condenser lens which improves control over the beam spread characteristics, while at the same time reduces the package size of the headlamp assembly. According to one embodiment, a condenser lens is provided for a projector-type headlamp assembly having a light source emitting light which is projected longitudinally downstream in front of a motor vehicle. The condenser lens generally includes a main body of light transmitting material. The main body defines a first surface receiving light from the light source and a second surface emitting the light. The second surface has at least one facet structured to spread the light and provide a predetermined beam pattern.

According to more detailed aspects, the at least one facet separates the horizontal beam spread from the vertical beam spread. Preferably, the second surface has at least two facets and most preferably comprises a plurality of horizontally spaced facets extending vertically. Alternatively, the at least one facet may comprise a single facet forming the second surface and having a saddle-shape. When a plurality of horizontally spaced facets are employed, the curvature of each of the facets in the vertical direction determines the vertical spread, while the curvature of the plurality of facets in the horizontal direction determines the horizontal spread. Generally, the plurality of horizontally spaced facets forms a series of peaks and valleys on the second surface. The vertical curvatures of the plurality of facets are asymmetric relative to a horizontal axis in order to preserve the horizontal cut-off while generating the desired vertical beam spread. The facets may have either a convex curvature or a concave curvature in the horizontal direction. It will be recognized that the facets may be structured to create a predetermined beam pattern that includes regions of higher light intensity. Additionally, the cross-sectional shape of the condenser lens is no longer limited to being circular, and thus may take a square or rectangular shape to match the shape of the light emitting surface of the LED, or may take any other non-circular shape such as an oval or other oblong shapes.

Another embodiment constructed in accordance with the teachings of the present invention provides a projector-type headlamp assembly for a motor vehicle which generally includes a light source, a reflector, and a condenser lens. The condenser lens is constructed in a fashion similar to the numerous constructions described above, thereby providing a predetermined beam pattern. By shifting the duties of spreading the light to the condenser lens, the reflector may comprise a simple elliptical reflector having a circular cross-sectional shape. That is, the reflector need not be elongated in the horizontal direction or otherwise specifically constructed to generate the desired beam spread pattern. A shield may also be employed in the projector-type headlamp assembly to provide a horizontal cut-off. Preferably, the shield is tilted slightly away from the light source and toward the lens thereby improving light collection.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
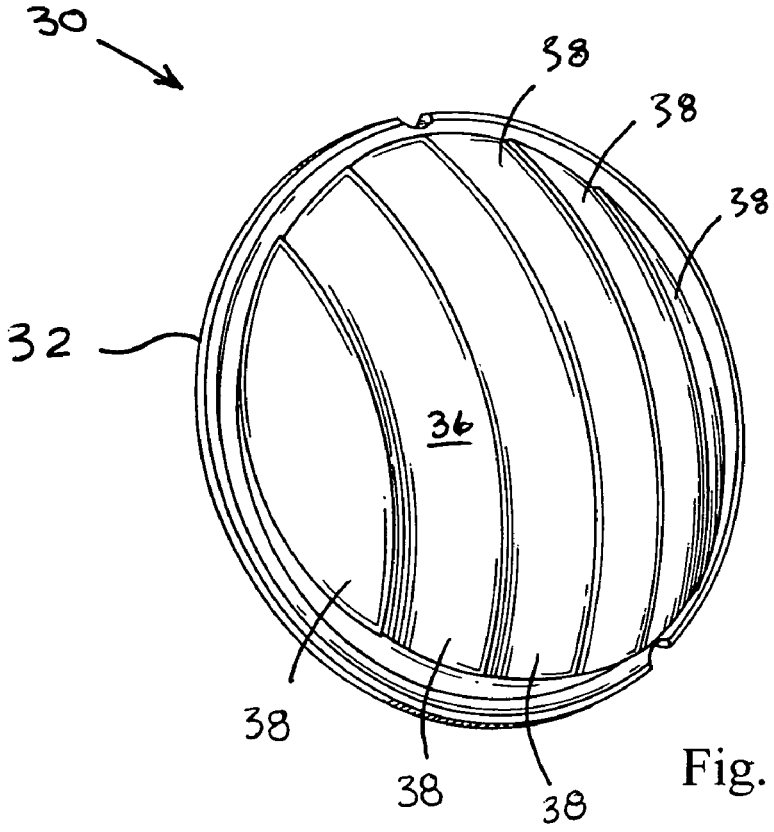
FIG. 1 is a perspective view of a condenser lens constructed in accordance with the teachings of the present invention.
Figure 2:
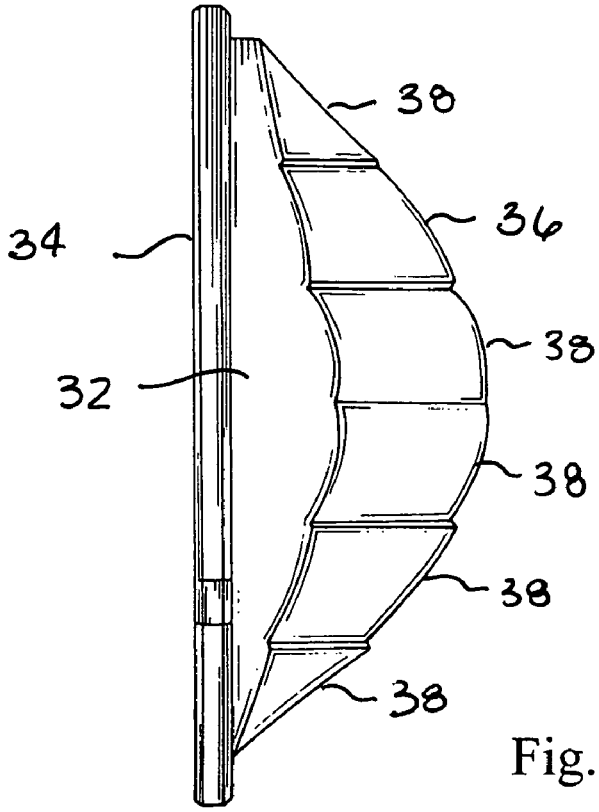
FIG. 2 is a bottom view of the condenser lens depicted in FIG. 1.

Turning now to the figures, FIGS. 1 and 2 depict a condenser lens 30 constructed in accordance with the teachings of the present invention. Notably, the condenser lens 30 is capable of imparting beam spread characteristics into the light outputted from the headlamp assembly 20 (FIG. 3) of which it is a part of, as will be discussed in more detail herein below. Additionally, the condenser lens 30 is capable of creating specified vertical spread and horizontal spread functions for each facet, thereby providing a highly adaptable condenser lens which can be tailored for a specific number of vehicles or desired beam characteristics. By moving the function of beam spread from the reflector to the condenser lens, standard elliptical reflectors may be employed in conjunction with LED light sources to provide a light output that is suitable for automotive headlight applications while also having the desired beam characteristics.

The condenser lens 30 generally comprises a main body 32 having a first surface 34 and a second surface 36 which are longitudinally spaced apart. The first surface 34 receives light from the light source 22 (FIG. 3) and is generally planar and perpendicular to a longitudinal axis 10 (FIG. 3), although it can be curved. When aligned with the center of the condenser lens 30, the longitudinal axis 10 can also be considered the optical axis of the assembly 20. As best seen in FIG. 2, the second surface 36 is formed as a plurality of facets 38, and particularly the embodiment of FIG. 2 includes six (6) facets although any number of facets may be readily employed. The facets 38 are generally vertically extending while being horizontally spaced, although while it is possible to have facets that are both vertically and horizontally spaced like a checker board design pattern. Each of the facets 38 have a generally convex curvature in the horizontal and vertical directions, and most preferably are numerically generated free form surfaces designed to provide a desired output beam. The vertical line where adjacent facets 38 meet are preferably as smooth as possible to avoid big steps between neighboring facets and depends on the nature of the particular horizontal curvatures of adjacent facets 38. Given that each of the facets 38 may have their own horizontal curvature, a number of peaks and valleys are generally defined by the horizontal curvature of the second surface 36.

Figure 3:
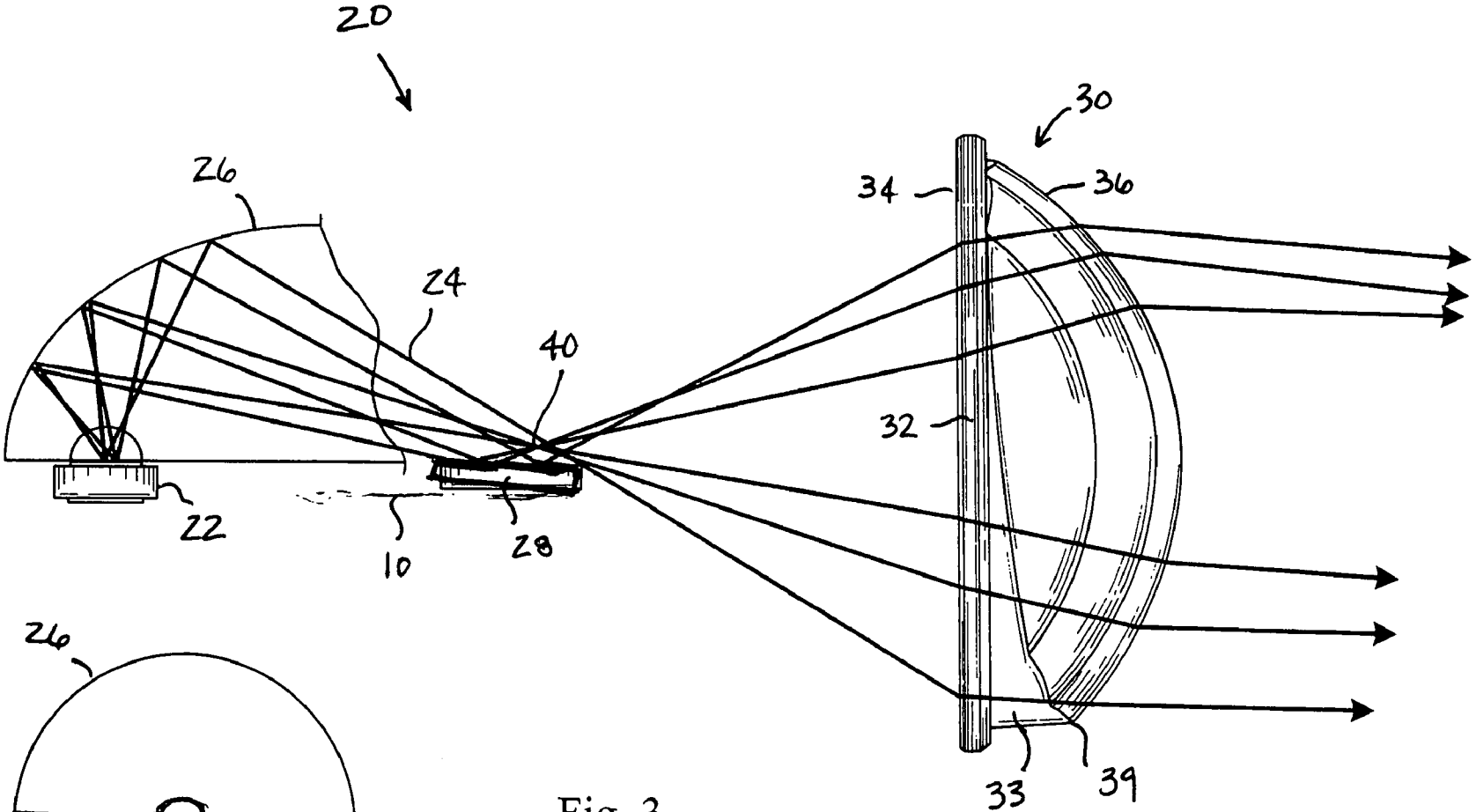
FIG. 3 is a side view of a headlamp assembly constructed in accordance with the teachings of the present invention and employing the condenser lens depicted in FIG. 1.
Figure 3A:
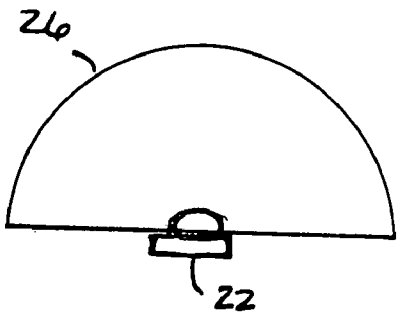
FIG. 3A is a front view of a reflector and light source forming a portion of the headlamp assembly depicted in FIG. 3.

Turning now to FIG. 3, a headlamp assembly 20 employing the condenser lens 30 has been depicted. In addition to the condenser lens 30, the headlamp assembly 20 generally includes a light source 22 emitting light 24 which is collected and redirected by a reflector 26. Preferably, the light source 22 is a LED which generally produces light from a surface area, as is known in the art. The reflector 26 is preferably an elliptical reflector meaning it has an elliptical curvature as best seen from the side view of FIG. 3, and therefore when the LED 22 is placed at the reflector's first focal point, the reflector 26 focuses light towards its second focal point 40, which also generally coincides with a focal point of the condenser lens 30, as is known in the art. It will be recognized by those skilled in the art that since the condenser lens 30 will be performing all or a portion of the beam spreading function, the reflector 26 may comprise a elliptical reflector having a generally circular cross-section, as best seen in FIG. 3A. Although an oblong or oval reflector 26 could be employed to share in a portion of the beam spreading function, the use of a circular elliptical reflector as depicted (or an oblong reflector of less width) results in a headlamp assembly 20 having reduced package size due to a reduced width (and possibly reduced height if the reflector 26 was performing some vertical beam spreading function).

Returning to FIG. 3, the light 24 produced from the LED light source 22 is collected and focused toward the second focal point 40 where a shield 28 is positioned such that a portion of the light is redirected upwardly towards an upper half of the condenser lens 30. Generally, the portion of the light 24 which would otherwise produce a upward beam divergence is reflected as shown, whereby most if not all of the light exiting the second surface 36 of the condenser lens 30 is directed horizontally or slightly downwardly within the preferred vertical beam spread of −10°. According to one feature of the present invention, the reflective shield 28 is preferably tilted slightly towards the condenser lens 30, which has been found by the applicants to improve light collection by 3-15% depending upon the amount of the tilt. Specifically, the rear or upstream end of the shield 28 is tilted upwardly while the front end generally maintains its position in the vertical direction. It will also be recognized that flat or curved shields 28 of any shape may be employed and tilted as described. The shield 28 is preferably tilted by about 0° to 6° relative to the longitudinal axis 10.

It will also be recognized by those skilled in the art that the curvature of the second surface 36, and particularly the vertical curvature as defined by the plurality of facets 36, controls the vertical beam spread. Preferably, the vertical curvature of the second surface 36 is asymmetric relative to the longitudinal axis 10, whereby the outputted light 24 is skewed slightly downwardly to preserve the vertical cut-off while creating the desired vertical beam spread. As such, the main body 32 includes a semi-annular surface 33 resulting from the downward end 39 of the second surface 36 being spaced further away from the first surface 34 than an upper edge of the second surface 36 is spaced away from the first surface 34 causing a prism effect. Accordingly, it will be recognized by those skilled in the art that through the use of a condenser lens 30 having a second light emitting surface 36 formed as a plurality of facets 38, both a horizontal spread and a vertical spread can be introduced into the light beam outputted by the headlamp assembly 20.

Figure 4:
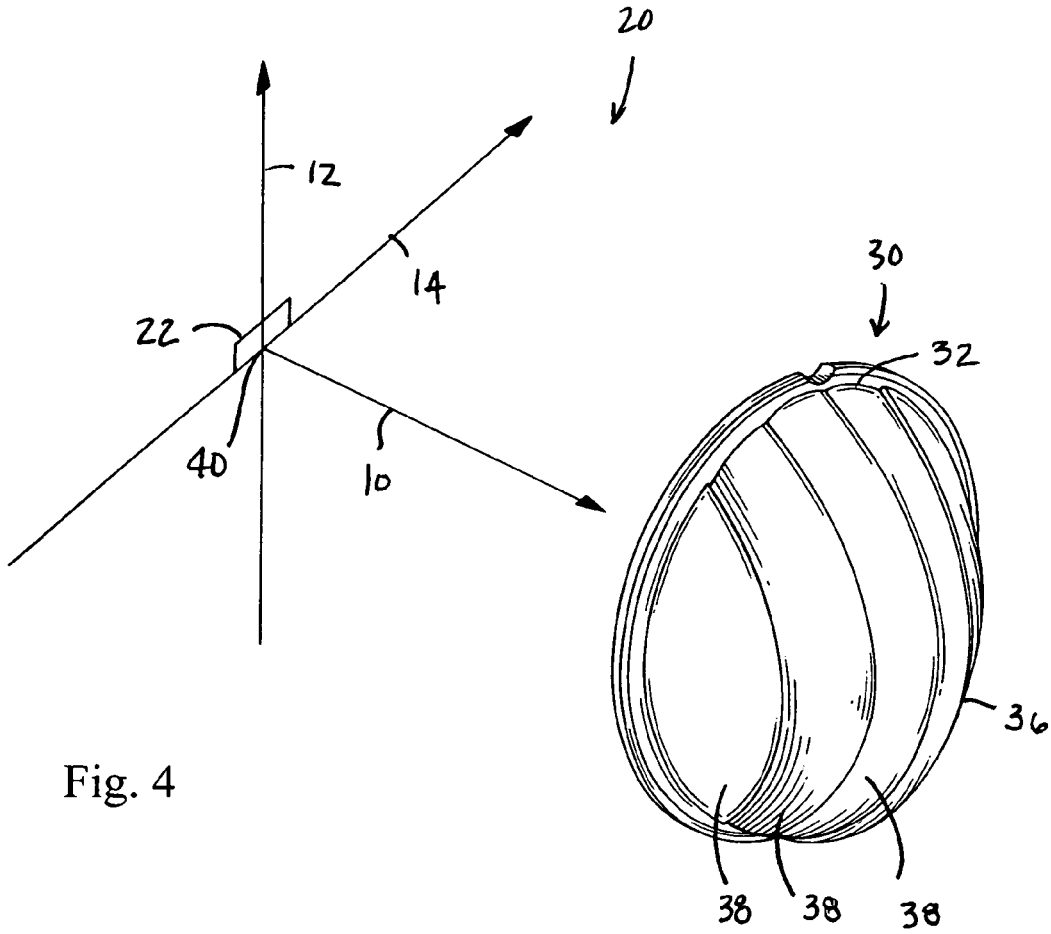
FIG. 4 is a perspective view of the headlamp assembly depicted in FIG. 3.
Figure 5:
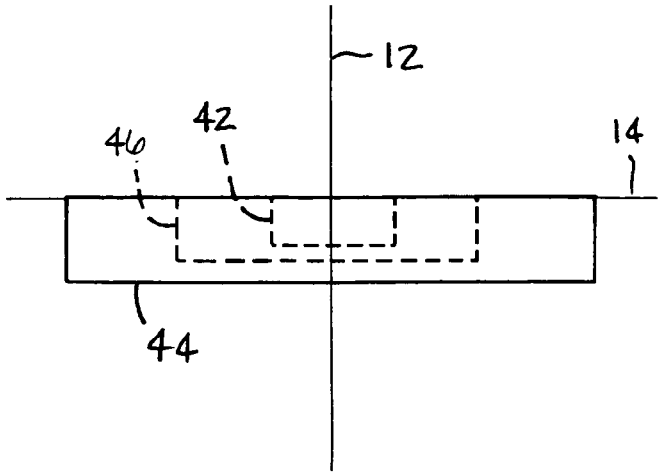
FIG. 5 is a schematic view depicting a beam pattern produced by the headlamp assembly of FIG. 3.

Turning to FIG. 4, a schematic depiction of the headlamp assembly 20 shows the light source 22 having a rectangular shape such as would be produced by a LED light source, and which is positioned at a focal point 40 of the condenser lens 30 and relative to a vertical axis 12, horizontal axis 14 and optical or longitudinal axis 10. It will also be recognized by those skilled in the art that the headlamp assembly 20 could include a direct projection headlamp whereby the LED 22 would be positioned generally as shown by numeral 22 in the FIG. 4. In either case, the condenser lens 30 receives light at its first surface 34, and through the construction of the second surface 36 having a plurality of facets 38, a predetermined beam pattern 44 is produced as shown in FIG. 5. If a standard aspheric condenser lens (i.e., axi-symmetric) lens were employed, the lens would simply project the light source 22 placed at its focal point 40, as indicated by the area of dotted line 42. However, through the use of the condenser lens 30 of the present invention, a predetermined beam pattern 44 may be generated having increased horizontal spread as well as increased vertical spread. Preferably, the predetermined beam pattern 44 has a horizontal spread of +/−35° while the vertical spread is about 0° to minus 10°. It will also be recognized that through the tailoring of individual facets 38, a hot spot, say for example the area indicated by dotted line 46, can be created. That is, each of the facets 38 may have their own unique curvature in either or both of the vertical and horizontal directions which can be structured to overlap or separate the light the lens 30 outputs, thereby creating a predetermined beam spread pattern. For example, assuming the facets 38 were numbered consecutively from left to right, facets 2 and 5 could be utilized to create a particular hot spot or hot spots while the remainder of the facets could be structured to provide a more uniformly spread beam pattern. Accordingly, it will be recognized that the horizontal spread and vertical spread functions of the condenser lens 30 is separated by use of the horizontally spaced and vertically extending facets 38.

Figure 6:
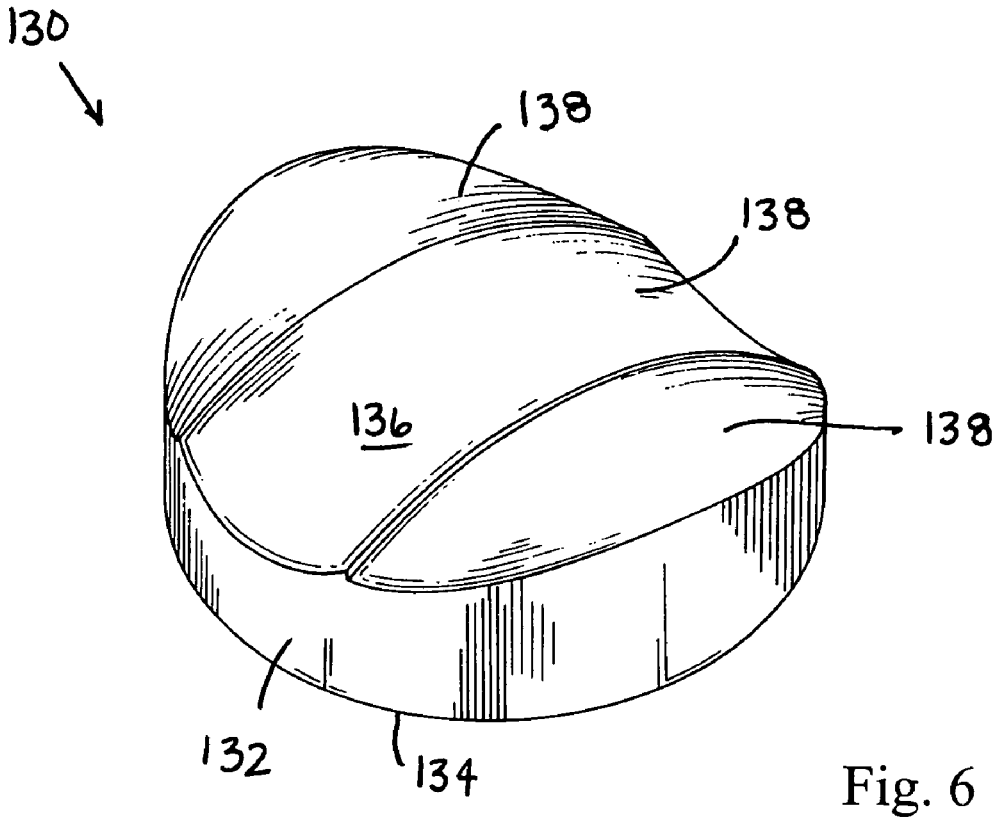
FIG. 6 is a perspective view of another embodiment of a condenser lens constructed in accordance with the teachings of the present invention.
Figure 7:
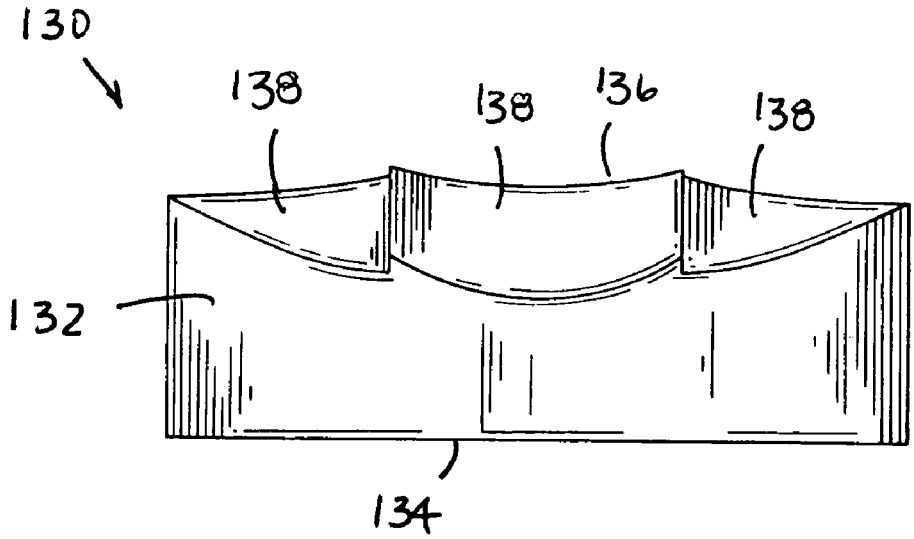
FIG. 7 is a bottom view of the condenser lens depicted in FIG. 6.

Turning now to FIG. 6, another embodiment of a condenser lens 130 is depicted in accordance with the teachings of the present invention. The condenser lens 130 includes a main body 132 having a first surface 134 receiving light and a second surface 136 for emitting the light longitudinally downstream in front of the vehicle to illuminate the roadway. The second surface 136 includes a plurality of facets 138, which number three (3) in this embodiment. As best seen in FIG. 7, each of the facets 138 has a horizontal curvature which is generally concave in shape, unlike the convex curvature given to the facets 38 of the prior embodiment. Similar to the prior embodiment, each of the facets 138 includes a vertical curvature which is preferably asymmetric relative to the longitudinal axis or otherwise constructed to preserve the vertical cut-off while introducing a predetermined amount of vertical beam spread.

Figure 9:
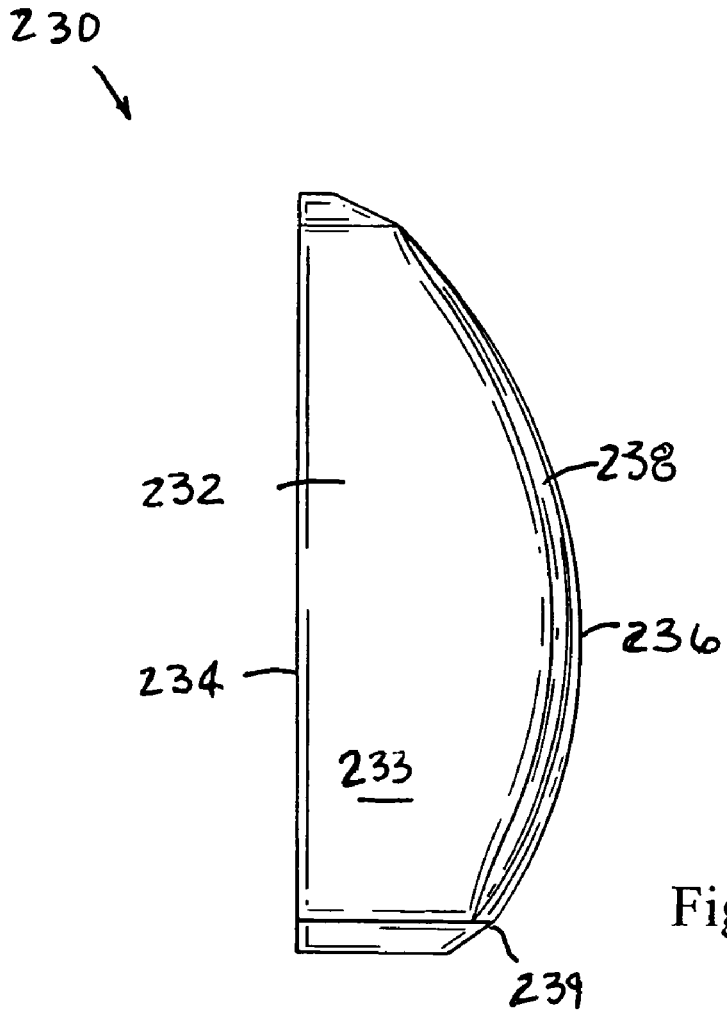
FIG. 9 is a side view of the condenser lens depicted in FIG. 8.
Figure 8:
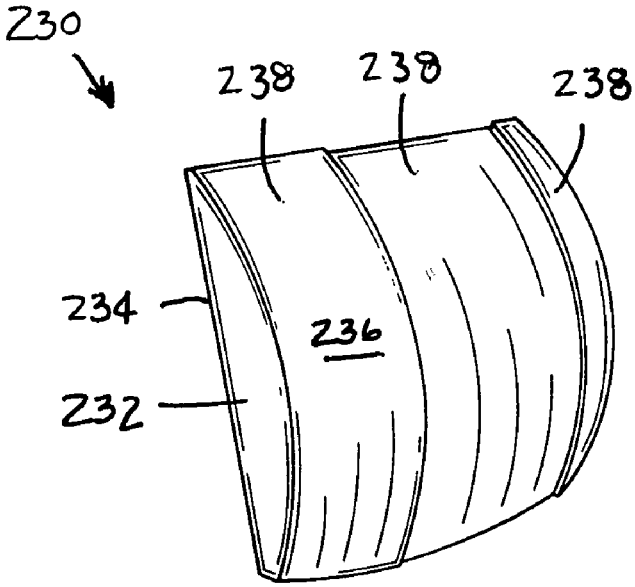
FIG. 8 is a perspective view of yet another embodiment of a condenser lens constructed in accordance with the teachings of the present invention.

Turning now to FIGS. 8 and 9, yet another embodiment of a condenser lens 230 is depicted in accordance with the teachings of the present invention. The condenser lens 230 generally includes a main body 232 having a first light receiving surface 234 and a second light emitting surface 236. The second surface 236 generally is formed by a plurality of horizontally spaced and vertically extending facets 238 which function to separate the horizontal spread and vertical spread functions of the condenser lens 230. Also similar to prior embodiments, the vertical curvature of the second surface 236 and its facets 238 is slightly asymmetric or tilted relative to a longitudinal axis to ensure the light is directed below the vertical cut-off. Thus, a lower end 239 of the lower edge 239 of the second surface 236 is spaced further away from the first surface 234 than an upper edge.

Notably, it will be recognized by those skilled in the art that the embodiment of FIGS. 8 and 9 provide a condenser lens 230 having a generally square or rectangular shape. In this manner, the condenser lens 230 may be shaped to correspond with the light source, such as an LED light source 22 which emits light from a surface such as a square or rectangular surface. As such, it will be recognized that the condenser lens 230, and particularly as light receiving surface 234, may take any shape, circular or non-circular, including rectangular, square, oval or other oblong shapes. In this manner, unused material of the condenser lens 230 can be eliminated, reducing the weight of the lens 230 and headlamp assembly, thereby providing a headlamp assembly which is lighter and smaller.

Figure 10:
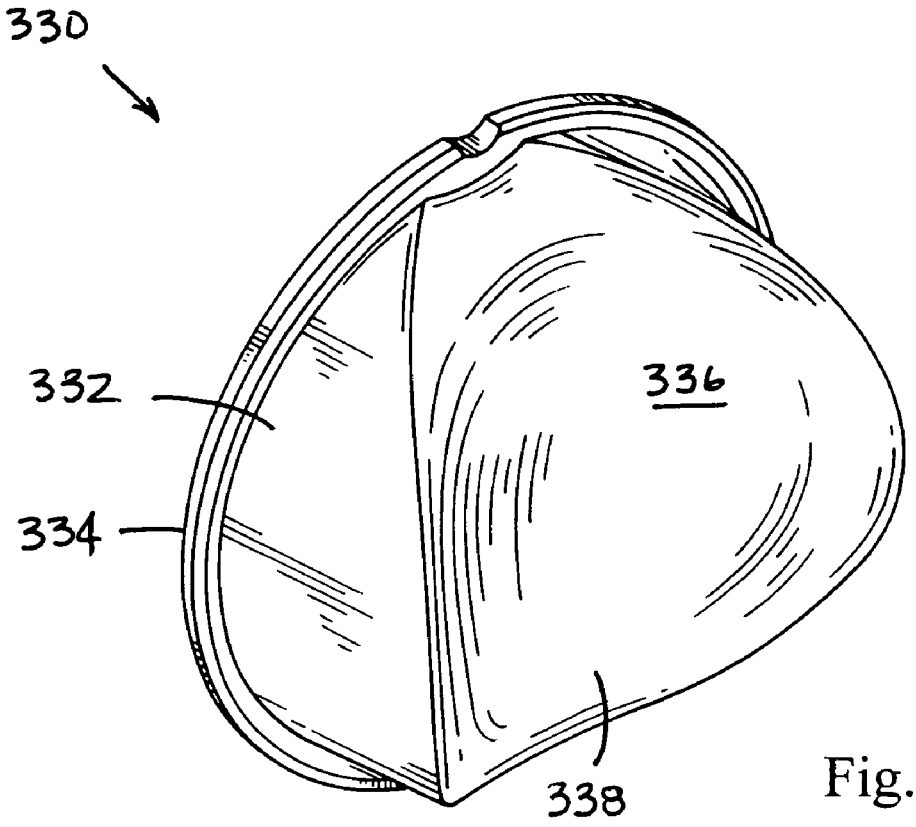
FIG. 10 is a perspective view of still yet another embodiment of a condenser lens constructed in accordance with the teachings of the present invention.
Figure 11:
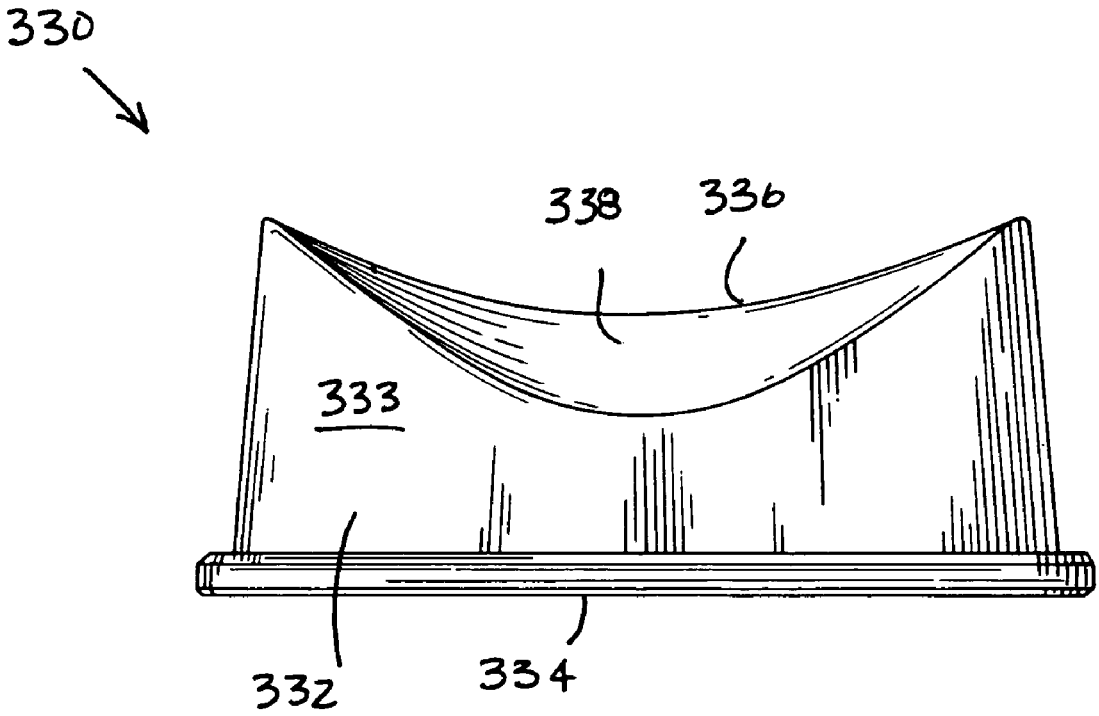
FIG. 11 is a bottom view of the condenser lens depicted in FIG. 10.
Figure 12:
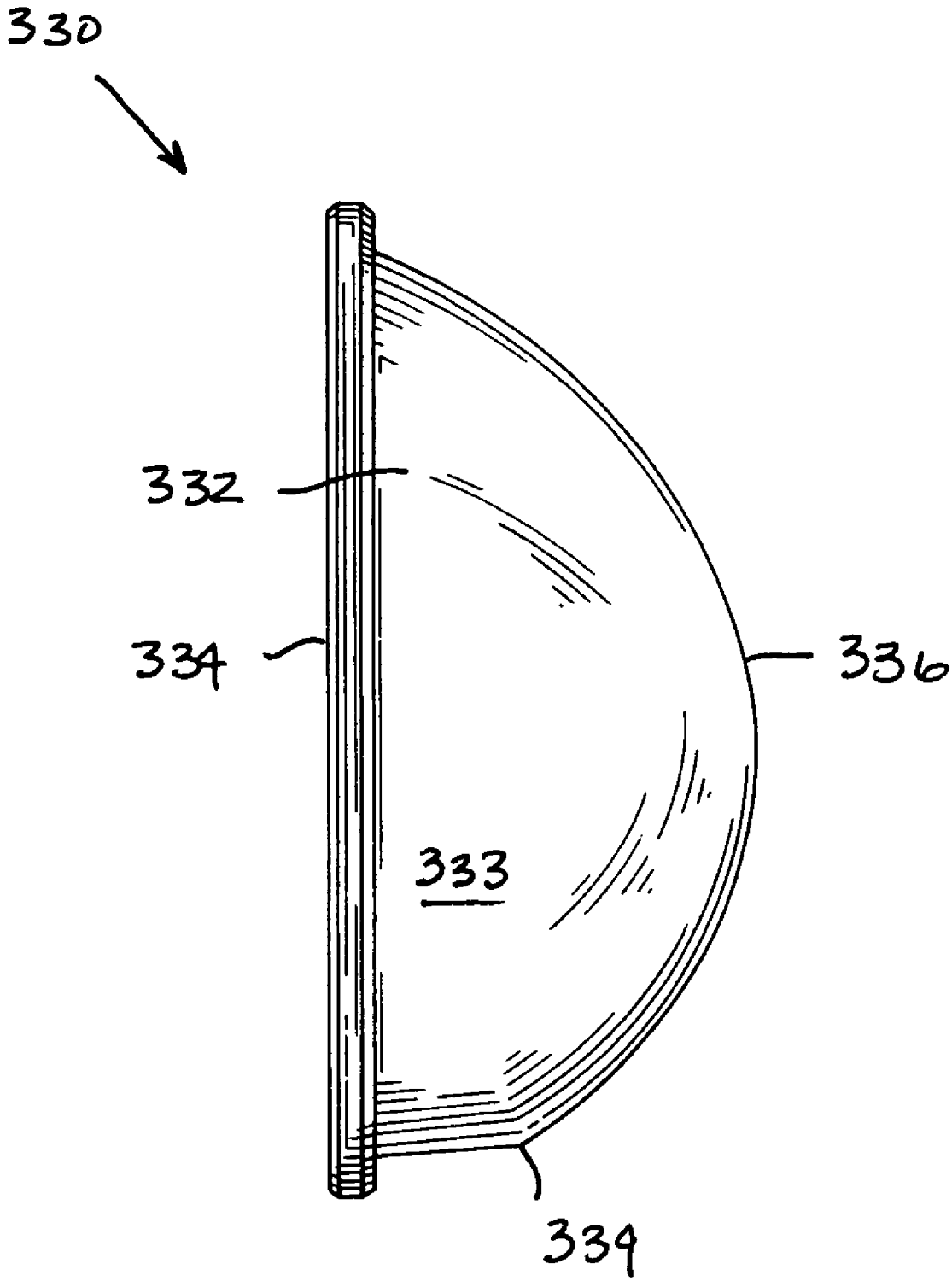
FIG. 12 is a side view of the condenser lens depicted in FIG. 10.

Turning now to FIGS. 10 and 11, yet another embodiment of a condenser lens 330 has been depicted in accordance with the teachings of the present invention. Generally, the lens 330 includes a main body 332 having a first light receiving surface 334 and a second light emitting surface 336. Unlike the prior embodiments, the second surface 336 includes a single facet 338 which thus itself defines the light emitting surface. In this case, the single facet 338, (and hence second surface 336), has a saddle-shape which is curved in three dimensions and results in a separation of the horizontal spread and vertical spread of the predetermined beam pattern. As seen in the side view of FIG. 11, the main body 332 thus includes a peripheral surface 333 having a generally annular shape. It will be recognized by those skilled in the art that the single facet 338 and second surface 336 may be uniquely formed to provide any desired beam pattern and having predetermined vertical and horizontal beam spread. Preferably, the surface 336 is numerically generated to create the predetermined desired beam pattern.

Accordingly, it will be recognized by those skilled in the art that the present invention provides a condenser lens and headlamp assembly which uniquely utilizes the condenser lens to provide some or all of the beam spreading function. Furthermore, this beam spreading function may be divided into its horizontal and vertical components for individualized tailoring of the outputted beam pattern. Likewise, hot spots or other desirable beam characteristics may be produced through the tailored construction of the light emitting surface and its facets. It will also be recognized by those skilled in the art that many variations could readily be employed. For example, the plurality of facets could be vertically spaced and horizontally extending, which would still result in a separation of the horizontal and vertical beam spread functions. Likewise, an unlimited number of unique single facet and multi-facet embodiments can be readily envisioned by those skilled in the art and can be tailored to specific applications.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A condenser lens for a projector-type headlamp assembly of a motor vehicle, the projector-type headlamp assembly including a light source emitting light which is projected longitudinally downstream in front of the motor vehicle, the condenser lens comprising:

a main body of light transmitting material, the main body defining a first surface receiving light from the light source and a second surface emitting the light, the second surface having a generally concave curvature to horizontally and vertically focus the light;

the second surface having a plurality of facets structured to horizontally focus the light differently from the vertical focus of the light to provide a predetermined beam pattern having an increased horizontal beam spread relative to an aspheric condenser lens.

2. The condenser lens of claim 1, wherein the plurality of facets are vertically elongated to separate the horizontal beam spread from the vertical beam spread.

3. The condenser lens of claim 1, wherein the plurality of facets are horizontally spaced and extend vertically.

4. The condenser lens of claim 3, wherein the curvature of each of the plurality of facets in the vertical direction determines the vertical spread, and wherein the curvature of the plurality of facets in the horizontal direction determines the horizontal spread.

5. The condenser lens of claim 3, wherein the plurality of horizontally spaced facets form a series of peaks and valleys on the second surface.

6. The condenser lens of claim 3, wherein the vertical curvatures of the plurality of faces are asymmetric relative to a horizontal axis to vertically skew the light.

7. The condenser lens of claim 3, wherein each of the plurality of facets has a vertical curvature and a horizontal curvature, and wherein the slope of the horizontal curvature is different than the slope of the vertical curvature.

8. The condenser lens of claim 7, wherein the plurality of facets include a first facet having a first horizontal curvature and a second facet having a second horizontal curvature, and wherein the slope of the first horizontal curvature is different from the slope of the second horizontal curvature.

9. The condenser lens of claim 8, wherein the horizontal curvature of the plurality of facets are structured to generate an area of increased light within the predetermined beam pattern.

10. The condenser lens of claim 1, wherein an upper edge of facets each of the plurality of is spaced from the first surface a first distance, and wherein a lower edge of each of the plurality of facets is spaced from the first surface a second distance, the first distance being less than the second distance.

11. The condenser lens of claim 1, wherein each of the plurality of facets has a convex curvature.

12. The condenser lens of claim 1, wherein the at least one facet has a concave curvature.

13. The condenser lens of claim 1, wherein the at least one facet comprises a single facet forming the second surface emitting the light, and wherein the second surface has a saddle-shape.

14. The condenser lens of claim 1, wherein the first surface takes a non-circular shape.

15. The condenser lens of claim 1, wherein the predetermined beam pattern includes a horizontal region of higher light intensity.

16. A projector-type headlamp assembly of a motor vehicle comprising:

a light source emitting light;

a reflector collecting light from the light source and projecting the light longitudinally downstream;

a condenser lens having a main body defining a first surface receiving light from the reflector and a second surface emitting the light, the second surface having a generally concave curvature to horizontally and vertically focus the light and provide a predetermined beam pattern, the second surface having at least one vertically elongated facet having one of a convex and a concave curvature that provides a horizontal beam spread component to the predetermined beam pattern.

17. The condenser lens of claim 16, wherein the second surface has at least two facets.

18. The headlamp assembly of claim 16, wherein the light source is an LED.

19. The headlamp assembly of claim 16, wherein the reflector is an elliptical reflector having a circular cross-sectional shape.

20. The headlamp assembly of claim 16, further comprising a shield.

21. The headlamp assembly of claim 20, wherein the shield is tilted away from the light source and towards the lens.

22. The headlamp assembly of claim 16, wherein the at least one facet horizontally focuses the light differently that the at least one facet vertically focuses the light.

23. The headlamp assembly of claim 21, wherein the shield is tilted relative to horizontal less than about 6°.

* * * * *